United States Patent [19]

Williams

[11] Patent Number: 4,852,494

[45] Date of Patent: Aug. 1, 1989

[54] EXPLOSIVELY ACTUATED SWITCH

[76] Inventor: Robert A. Williams, 2721 White Settlement Rd., Fort Worth, Tex. 76107

[21] Appl. No.: 281,886

[22] Filed: Dec. 6, 1988

Related U.S. Application Data

[63] Continuation of Ser. No. 121,416, Nov. 16, 1987, abandoned.

[51] Int. Cl.[4] ..... F42C 15/40; H01H 39/00

[52] U.S. Cl. ..... 102/263; 200/61.08

[58] Field of Search ..... 89/1.14, 1.15, 217, 89/263; 102/217, 263; 175/4.54, 4.56; 200/61.08, 82 R

[56] References Cited

U.S. PATENT DOCUMENTS

| | | | |
|---|---|---|---|
| 2,931,874 | 4/1960 | Leaman | 200/61.08 |
| 3,155,800 | 11/1964 | Denton | 200/61.08 |
| 3,793,501 | 2/1974 | Stonestrom | 200/61.08 |
| 3,839,608 | 10/1974 | De Vries | 200/82 R |
| 3,860,865 | 1/1975 | Stroud et al. | 89/1.15 |
| 4,007,796 | 2/1977 | Boop | 200/61.08 |
| 4,099,467 | 7/1978 | MacKellar et al. | 102/217 |
| 4,150,266 | 4/1979 | Patrichi | 200/82 R |
| 4,417,519 | 11/1983 | Lutz | 102/263 |
| 4,489,655 | 12/1984 | Molnar | 102/217 |
| 4,630,360 | 12/1986 | Ochsner et al. | 200/82 R |

*Primary Examiner*—David H. Brown

*Attorney, Agent, or Firm*—Arthur F. Zobal

[57] ABSTRACT

A body member has an opening formed therein. A receiving contact is located in the opening of the body member and has an electrical lead connected thereto which extends out of the body member. The receiving contact has a cavity with an opening at one end which faces the plunger end of the body member. An interior contact is located in the cavity of the receiving contact and is electrically insulated therefrom. An electrical lead is connected to the interior contact and extends out of the body member. A moveable plunger including a plunger contact is located in the opening of the plunger end of the body member. The plunger contact has an opening which releasably supports a shuttle contact at a position spaced away from the interior contact. In this position an electrical connection is provided between the receiving contact lead and the plunger contact by way of the receiving contact and the shuttle contact. Silicone grease is located around the shuttle contact and the plunger contact and in the opening of the plunger contact behind the shuttle contact. An explosive force on the other side of the plunger forces it toward the receiving contact until it is stopped causing the silicone grease to force the shuttle contact from the plunger contact into engagement with the interior contact and the interior wall of the receiving contact to form an electrical connection between the two leads.

22 Claims, 4 Drawing Sheets

EXPLOSIVELY ACTUATED SWITCH

This is a continuation of co-pending application Ser. No. 121,416 filed Nov. 16, 1987, now abandoned.

BACKGROUND OF THE INVENTION

1. Description of the Prior Art

In the completion of oil wells drilled into the earth, perforating guns are employed for perforating the casing in the borehole for production purposes. A plurality of vertically spaced apart detonating devices are sequentially actuated to perforate the casing at a plurality of vertically spaced apart positions. The detonating devices are sequentially actuated by switches which are sequentially closed with each switch being closed by the explosive force caused by actuation of a preceding lower detonating device. The prior art switches in use, however, are unreliable.

2. Summary of the Invention

It is an object of the invention to provide a switch which is reliably closed by an explosive force.

The switch of the invention comprises a body means having an opening extending therein with two coaxial contacts located in the opening and electrically insulated from each other. Electrical leads are connected to the two contacts and extend out of the body means. A plunger means located in the opening of the body means is moved by explosive force to cause a third contact to engage the two coaxial contacts in the opening to form an electrical connection between the two leads.

In a further aspect, one of the contacts of said body means comprises a receiving contact located in the opening of said body means and which has a cavity formed therein with an opening leading to the cavity. The other contact located in the opening of said body means comprises an interior contact which is located in the cavity of said receiving contact. The third contact comprises a shuttle contact which is releaseably supported by the plunger means at one end thereof. Upon force being applied to the opposite end of the plunger means, the plunger means moves toward the receiving and interior contacts to a given position where its movement is stopped and the shuttle contact is released from the plunger means for movement into the cavity of the receiving contact for engaging both the receiving contact and the interior contact.

In another aspect, an electrical insulating, highly viscous material is located at least partially between the shuttle contact and the plunger means when the plunger means is located in its unactuated position for facilitating release of the shuttle contact from the plunger means upon the application of force to the opposite end of the plunger means.

In still another aspect, the plunger means comprises a plunger contact which releaseably supports the shuttle contact. When the plunger means is in its unactuated position, the end of the shuttle contact engages the receiving contact and an electrical connection is made between the lead of the receiving contact and the plunger contact by way of the receiving contact and the shuttle contact.

Figure 2A:
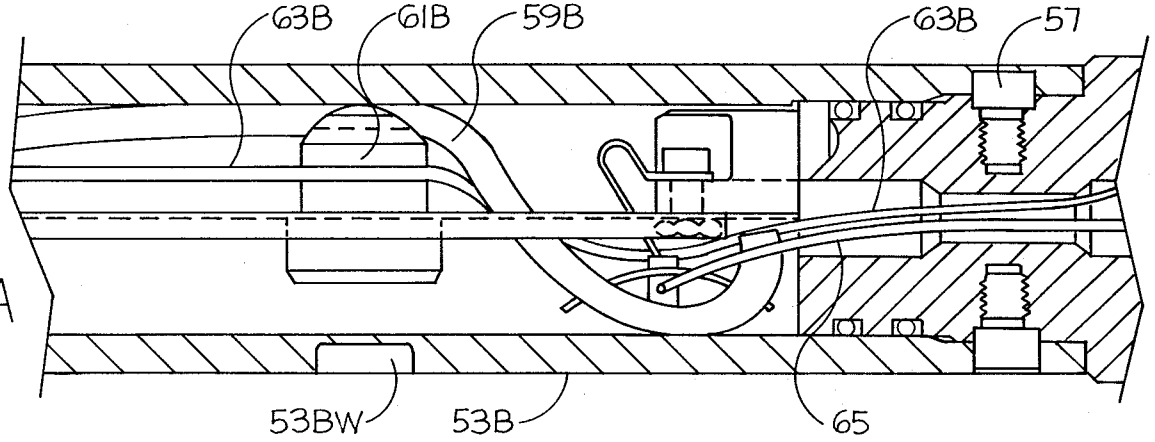
FIGS. 2A and 2B are cross-sectional views of a portion of a borehole apparatus employing the invention.
Figure 2B:
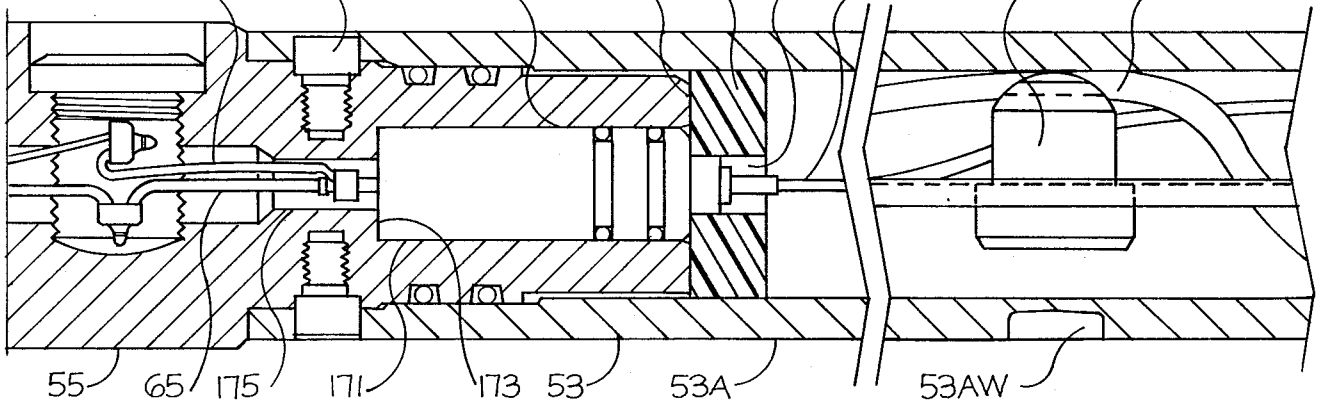

The left-hand side of FIG. 2B connects to the right-hand side of FIG. 2A.

Figure 3:
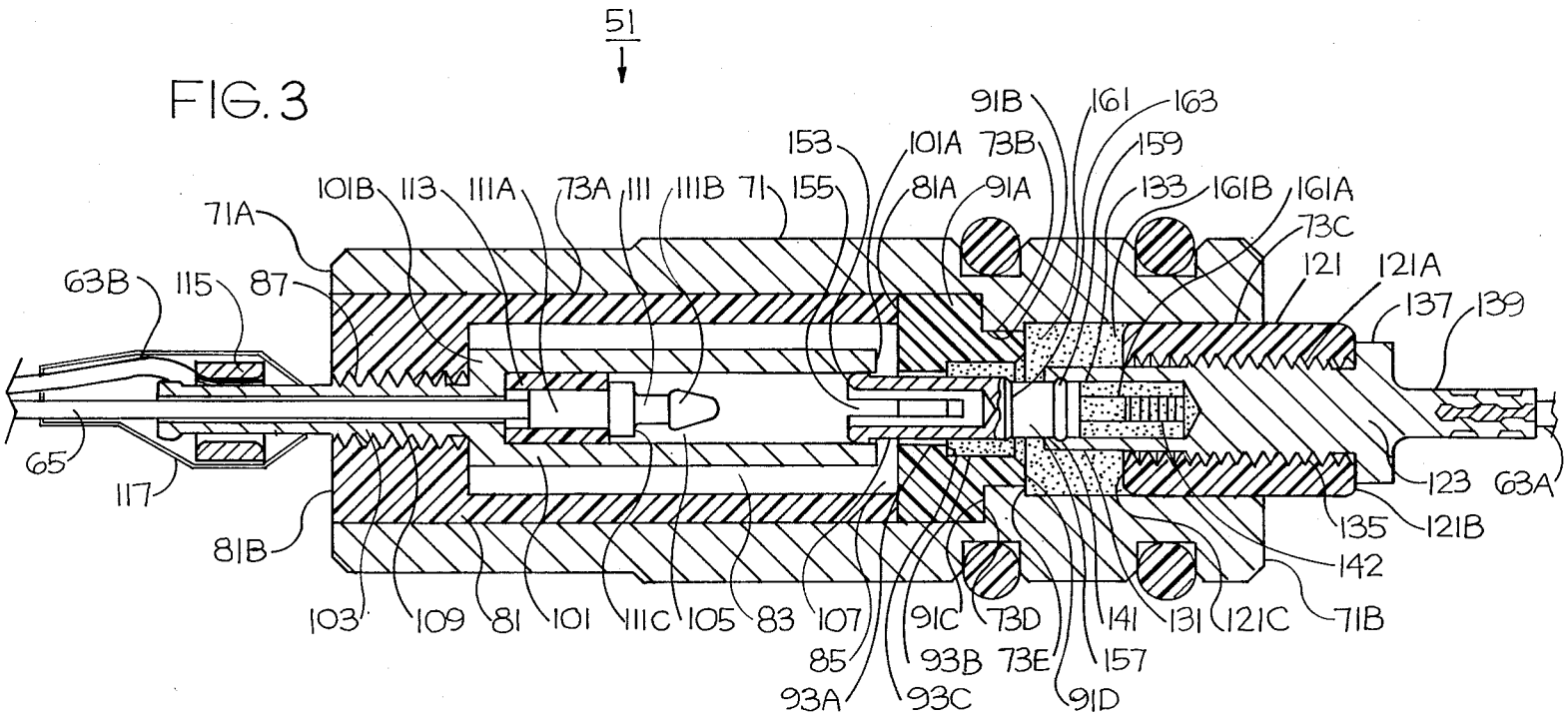

FIG. 3 is a cross-sectional view of the switch of the invention.

Figure 4:
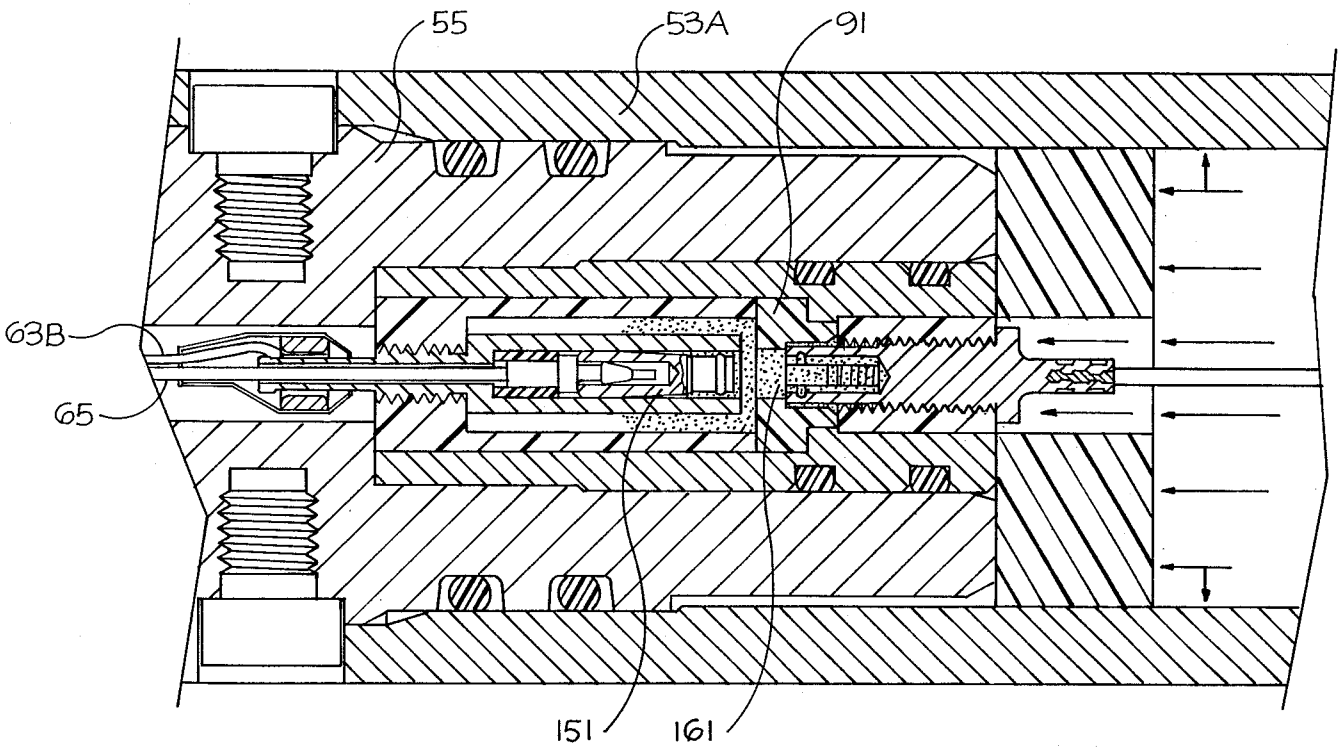

FIG. 4 is an enlarged partial cross-sectional view of the housing of FIG. 2B showing the switch of FIG. 3 located therein.

DESCRIPTION OF THE PREFERRED EMBODIMENT

Figure 1:
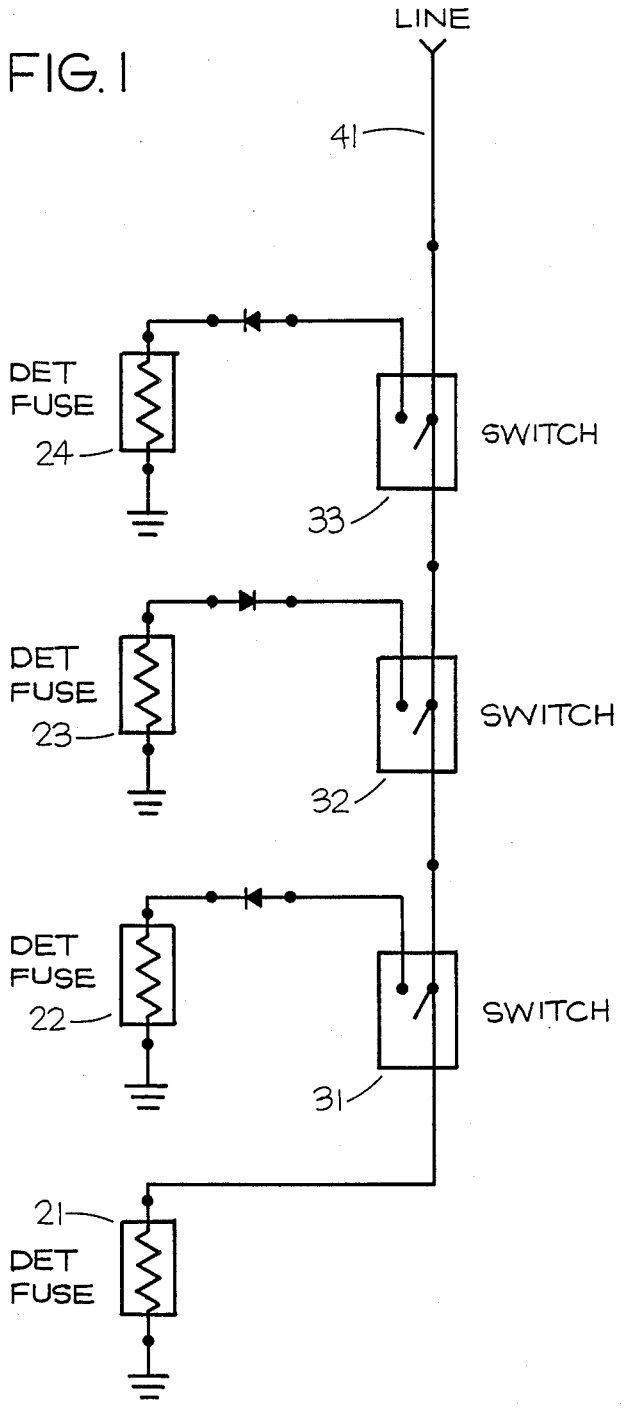
FIG. 1 schematically illustrates borehole detonation devices sequentially actuated by switches.

Referring to FIG. 1, there is disclosed an electrical schematic of a conventional progressive perforating gun assembly. The assembly comprises a plurality of detonating fuses 21–24 and switches 31–33 to be located in a borehole apparatus which is employed for perforating the casing of a borehole extending into the earth for oil well production purposes. An electrical lead 41 extends from the surface into the borehole downward to each of normally open switches 33, 32, and 31 to the lowest detonating fuse 21. Each of fuses 21–24 is connected to a ground connection which extends to the surface. Fuses 22–24 also are connected to normally open switches 31–33 respectively. Each of switches 31–33 is closed by the force of a preceding lower detonation. In operation, an electrical signal is applied from the surface to lead 41 to detonate fuse 21 to actuate its gun to perforate a hole in the casing at a lower level. The force of the explosion closes switch 31 and an electrical signal on lead 41 causes fuse 22 to detonate to actuate its gun to perforate the casing at the next upper level. The force of this explosion closes switch 32 and an electrical signal on lead 41 causes fuse 23 to detonate to actuate its gun to perforate the casing at the next upper level. The force of this explosion closes switch 33 and an electrical signal on lead 41 causes fuse 24 to detonate to actuate its gun to perforate the casing at the next upper level. As mentioned above, the prior art progressive perforation gun assembly is not reliable because of the prior art switches employed.

Referring to FIGS. 2A and 2B, there is disclosed one switch 51 of the invention located in the housing 53 of a progressive perforating gun assembly. A plurality of spaced apart switches 51 will be employed in the housing 53 each of which is employed to actuate its associated perforating gun. The switch 51 is supported by structure 55. The housing 53 comprises sections 53A and 53B connected to structure 55 by bolts 57. A primacord 59A and a perforating gun device 61A are located in the housing section 53A. A primacord 59B and a perforating gun device 61B are located in the housing section 53B. Another connecting structure 55 (not shown) supporting another switch 51 (not shown) connects the housing section 53B to an upper housing section which contains a primacord and a perforating gun device etc. The perforating gun device 61A actuated by the primacord 59A sends a projectile through weakened portion 53AW of the housing section 53A to perforate the casing of the borehole. The force of the explosion closes normally open switch 51 which forms an electrical connection between leads 63B and 65. This actuates the primacord 59B and hence the perforating gun device 61B which sends a projectile through the weakened portion 53BW of housing section 53B to perforate the casing of the borehole at this level. The force of the explosion closes the next upper switch 51 (not shown) whereby its associated primacord and perforating gun (not shown) may be actuated etc.

Lead 63B is electrically connected initially through the switch 51 to lead 63A to the next lower switch or to primacord 59A if gun 61A is the lowest gun and to the surface through the upper switches 51. In each housing section 53A and 53B, the primacord 59A and 59B is connected to the housing 53 which is ground. Lead 65 is connected to ground 53 by way of the prima cord.

Referring to FIGS. 3 and 4, the switch 51 comprises a metal tubular body 71 having a lead end 71A and a plunger end 71B with an opening extending therethrough. The opening comprises cylindrical portions 73A, 73B and 73C. Opening portions 73A extend through most of the body 71 from end 71A and has the largest diameter. Opening portion 73B has the shortest axial length and the smallest diameter. A shoulder 73D extends between opening portions 73A and 73B and a shoulder 73E extends between opening portions 73B and 73C.

Located within the opening portions 73A is a cylindrical shaped electrical insulating receiving member 81 having a cylindrical shaped cavity 83 with a large opening 85 at one end 81A and a smaller threaded opening 87 at the other end 81B, both of which lead to the cavity 83. The end 81B is located at the lead end 71A of the tubular body 71. Also located partially in the opening portion 73A and within the opening portion 73B is a center electrical insulator member 91 formed by cylindrical portions 91A and 91B of larger and smaller diameters respectively with a shoulder 91C extending therebetween. The shoulder 91C abuts against shoulder 73D of the tubular body member 71. Formed through the center insulator member 91 is an opening formed by cylindrical opening portions 93A and 93B of smaller and larger diameters respectively with a shoulder 93C extending therebetween. Insulator members 81 and 91 are formed of suitable electrical insulating plastic material.

A receiving contact 101 is secured within the cavity 81 by way of a threaded end 103 which is screwed through the threaded aperture 87. The threaded end 103 is integral with the contact 101 and both contact 101 and its threaded end 103 are formed of metal. The contact 101 has a cylindrical cavity 105 with an opening 107 leading thereto at one end 101A and a smaller opening 109 leading thereto at the other end 101B through the threaded end member 103. Electrical lead 65 extends through the opening 109 into the cavity 105 where it is electrically connected to a metal pin contact 111. A plastic sleeve 113 of electrical insulating material surrounds the rear end 111A of the contact 111 and spaces and electrically insulates it from the receiving contact 101. Electrical lead 63B is electrically connected to end contact 103 and hence to contact 101 by way of a metal collar 115. A plastic sleeve 117 of electrically insulating material surrounds the collar 115 and a portion of contact end 103.

Located within the opening 73C of the tubular body member 71 is a plunger comprising a plunger insulator 121 and a plunger contact 123. The plunger insulator 121 is cylindrical in shape and is formed of electrical insulating material. A threaded aperture 121A extends through the plunger insulator 121. The plunger contact 123 is formed of metal and has a front wall 131 with a cylindrical shaped opening 133 formed therein; a threaded intermediate portion 135; a radially extending flange 137; and a rear portion 139 to which the electrical lead 63A is electrically connected. The plunger contact 123 is screwed into the plunger insulator 121 until the flange 137 abuts against the rear end 121B of the plunger insulator 121. In this position, the rear end 139 of the plunger contact 123 extends outward beyond the rear end 121B of the plunger insulator 121. Formed in the front wall 131 of the plunger contact 123, which defines the opening 133, is an annular groove 141.

Releaseably secured in the opening 133 of the plunger contact 123 is a shuttle contact 151 formed of metal. The shuttle contact 151 has a plurality of separate arms 153 surrounding a central opening 155 and a rear end 157 with a rim 159. The rear end 157 of the shuttle contact 151 is inserted into the opening 133 of the plunger contact 123 with its rim 159 located in the groove 141. The rim 159 and groove 141 releaseably hold the contact shuttle 151 in the opening 133 of the plunger contact 123. A slot 142 is formed in the wall 131 of the plunger contact 123 on its inside from the opening 133. The slot 142 extends from the front edge of the wall 131 rearward. After the rear end 157 of the shuttle contact 151 is inserted in the opening 133 of the plunger contact 123, a thick highly viscous, electrically insulating material such as silicone grease 161 is suitably molded around the rear portion 157 of the shuttle contact 151 and around the forward wall 131 of the plunger contact 123 (which extends forward of the plunger insulator 121). The silicone grease also is injected through the slot 142 in the wall 131 into the opening 133 behind the rear end of the shuttle contact 151. The plunger 121, 123 then is inserted into the opening 73 of the tubular body member from its end 71B to a position such that the shuttle contact 151 extends through openings 93B and 93A of the center insulator 91 with its arms 153 located in the forward portion of the cavity 105 such that they engage the inside wall of the receiving contact 101 as shown in FIG. 3. In this position, an electrical connection is made from lead 63B to lead 63A by way of receiving contact 101, shuttle contact 151, and plunger contact 123. After the plunger 121, 123 has been inserted in place as shown in FIG. 3, silicone grease at 161A is in the opening 133 of the contact plunger 123 behind the rear end 157 of the shuttle contact 151 and at 161B is between the shoulder 93C of the center insulator 91 and the front end 121C of the plunger insulator 121 and within the openings 93B of center insulator 93 and 73C of the tubular body member, as shown in FIG. 3. The outside diameter of the plunger insulator 121 is sufficient such that a relatively tight fit is formed between it and the inside wall of the opening 73C of the tubular body member which is sufficient to hold the plunger 121, 123 in place as seen in FIG. 3 with no pressure or force applied to the back side of the plunger 121, 123. When sufficient force is applied to the back side of the plunger 121, 123 (by detonation of the primacord 59A and gun 61A), the plunger insulator 121 (and the plunger contact 123 and shuttle 151) will move forward until the end 121 of the plunger insulator is stopped by the shoulder 91D of the insulator member 91 and by the shoulder 73E of the tubular member 71. Forward movement of the plunger 121, 123 (and of the shuttle contact 151) forces the silicone grease at 161B forward against the rear facing shoulder 163 of the shuttle contact 151 and through the space between the shuttle contact 151 and the wall of the opening 93A. The detonation, forward movement of the plunger 121, 123, and the stopping of the plunger 121, 123 (when the plunger insulator end 121C engages the shoulder 91B of the member 91 and the shoulder 73E of the tubular member 71) causes a forward acting force to be applied to the rear end of the shuttle contact 151 by the silicone grease at 161A inside the opening 133. The silicone grease plus the fact the shuttle contact 151 is moving forward just before the plunger 121, 123 is stopped by the shoulder 91B of member 91 and the shoulder 73E of the tubular member 71 causes the shuttle contact 151 to be forced and released from the groove 141 and from the opening 133 of the front wall 131 of the plunger contact 123 and to be projected and forced forward in the opening 105 of the receiving contact 101 until it is stopped by engagement of the arms 153 with the pin contact 111, as shown in FIG. 4, wherein the arms 153 surround and engage the head 111B and the rearward facing shoulder 111C. In this position, the arms 153 also engage the inside wall of the receiving contact 101. This causes electrical lead 63B to be electrically connected to electrical lead 65. Connection is by way of the receiving contact 101, the shuttle contact 151 and the pin contact 111.

Referring to FIG. 2B, the switch 51 is located in the opening 171 of structural member 55 with its end 71A, 81B engaging the shoulder 173 of the opening 171. The leads 63B and 65 extend through the smaller opening 175 of the member 55, as shown in FIGS. 2A and 2B. A resilient member 177 of rubber or elastomer is located in the housing section 53A such that it engages the end 179 of member 55 and the end 71B of the body member 71. The member 177 has an aperture 181 formed therethrough for freely receiving the rear portion of the plunger 121, 123 and its lead 63A. The force of the detonation of the primacord 59A and the gun 61A is transmitted to the plunger 121, 123 by way of the opening 181.

In one embodiment, the silicone grease used in the invention may be of the type commercially available from Dow Corning and identified as DC-4.

I claim:

1. A switch, comprising:

body means having first and second ends with an opening extending into said body means at least from said second end, a first contact located in said opening of said body means, an electrical lead connected to said first contact and extending out of said body means, a second contact located in said opening of said body means and being normally electrically insulated from said first contact, an electrical lead connected to said second contact and extending out of said body means, said first and second contacts being coaxial with respect to each other, a third contact, plunger means located in said opening of said body means at said second end for movement from a first position toward said first end of said body means, said third contact being releasably coupled to a first end of said plunger means facing said second contact, means located at least partially between said third contact and said plunger means for applying pressure to said third contact in response to movement of said plunger means from said first position toward said first end of said body means for causing said third contact to be released from said plunger means for movement into engagement with said first and second contacts for forming an electrical connection between said two leads.

2. The explosively actuated switch of claim 1, wherein:

said plunger means is located in said opening of said body means at said second end for movement from said first position toward said first end of said body means to a second position, means for stopping movement of said plunger means when it reaches said second position, means for releasably coupling said third contact to said first end of said plunger means for allowing said third contact to be released from said plunger means at least when said plunger means is stopped at said second position for movement into engagement with said first and second contacts.

3. A switch, comprising:

body means having first and second ends with an opening extending into said body means at least from said second end, a receiving contact located in said opening of said body means, an electrical lead connected to said receiving contact and extending out of said body means, said receiving contact having a cavity therein within said opening of said body means, said receiving contact having an opening at one end leading to said cavity and facing said second end of said body means, an interior contact located in said cavity of said receiving contact and being normally electrically insulated therefrom, an electrical lead connected to said interior contact and extending out of said body means, a third contact, plunger means located in said opening of said body means at said second end for movement from a first position toward said interior contact to a second position, said third contact being releasably coupled to a first end of said plunger means facing said interior contact, means located at least partially between said third contact and said plunger means for applying pressure to said third contact in response to movement of said plunger means from said first position toward said interior contact to said second position for causing said third contact to be released from said plunger for movement into engagement with said interior contact and with said receiving contact for forming an electrical connection between said two leads.

4. The explosively actuated switch of claim 3, comprising:

means for stopping movement of said plunger means when it reaches said second position, means for releasably coupling said third contact to said first end of said plunger means for allowing said third contact to be released from said plunger means at least when said plunger means is stopped at said second position for movement into engagement with said interior contact and with said receiving contact.

5. The explosively actuated switch of claim 4, wherein:

said plunger means has an opening formed at one end facing said first end of said body means for releaseably supporting at least a portion of said third contact therein.

6. A switch, comprising:

body means having first and second ends with an opening extending into said body means at least from said second end, a receiving contact located in said opening of said body means, an electrical lead connected to said receiving contact and extending out of said body means, said receiving contact having a cavity therein within said opening of said body means, said receiving contact having an opening at one end leading to said cavity and facing said second end of said body means, an interior contact located in said cavity of said receiving contact and being normally electrically insulated therefrom, an electrical lead connected to said interior contact and extending out of said body means, a shuttle contact, plunger means located in said opening of said body means at said second end for movement from a first position toward said interior contact to a second position, means for stopping movement of said plunger means at said second position, said plunger means having an opening at one end facing said first end of said body means for releasably supporting at least a portion of said shuttle contact therein when said plunger means is in its first position such that said shuttle contact is located out of engagement with said interior contact, incompressible fluid means located at least partially between said shuttle contact and said plunger means, said plunger means being moveable, for force applied to its end opposite its opening, from its first position to its second position for causing said incompressible fluid means to apply pressure to said shuttle contact for causing said shuttle contact to be released from said plunger means for movement into engagement with said interior contact and with said receiving contact for forming an electrical connection between said two leads.

7. The switch of claim 6, wherein:

the structure of said plunger means forming said opening and said portion of said shuttle contact comprise means for releasably supporting said portion of said shuttle contact in said opening of said plunger means.

8. The switch of claim 6, wherein:

said incompressible fluid means comprises an electrical insulating highly viscous material.

9. The switch of claim 8, wherein:

the structure of said plunger means forming said opening and said portion of said shuttle contact comprise means for releasably supporting said portion of said shuttle contact in said opening of said plunger means.

10. The switch of claim 67, wherein:

said plunger means comprises an electrical conducting member with an opening formed in one end defining said opening of said plunger means for releasably supporting said portion of said shuttle contact therein, said shuttle contact when located in said opening of said electrical conducting member engages said electrical conducting member such that said shuttle contact and said electrical conducting member are electrically connected together, an end of said shuttle contact engages the inside wall of said receiving contact when said plunger means is in said first position whereby an electrical connection is provided between said first lead and said electrical conducting member by way of said receiving contact, said shuttle contact, and said electrical conducting member when said plunger means is in said first position.

11. The switch of claim 10, wherein:

said incompressible fluid means comprises an electrical insulating highly viscous material.

12. The switch of claim 11, wherein:

said one end of said receiving contact and at least a portion of the exterior wall thereof are spaced from the inside wall of said body means defining its opening forming a fluid flow space for said electrically insulating highly viscous material.

13. The switch of claim 12, wherein:

the structure of said electrical conducting member forming said opening of said electrical conducting member and said portion of said shuttle contact comprise means for releasably supporting said portion of said shuttle contact in said opening of said electrical conducting member.

14. A switch, comprising:

a body member having first and second ends with an opening extending into said body member at least from said second end, electrically insulating receiving means located in said opening of said body member and having a cavity with an opening at one end leading to said cavity and facing said second end of said body member, a receiving contact located in said cavity of said electrical insulating receiving means, an electrical lead connected to said receiving contact and extending out of said body member, said receiving contact having a cavity therein within said cavity of said insulating receiving means, said receiving contact having an opening at one end leading to its cavity and facing said second end of said body member, an interior contact located in said cavity of said receiving contact and being normally electrically insulated therefrom, an electrical lead connected to said interior contact and extending out of said body member, a shuttle contact, plunger means located in said opening of said body means at said second end for movement from a first position toward said opening of said insulating receiving means to a second position, means for stopping movement of said plunger means at said second position, said plunger means having an opening at one end facing said first end of said body member for releasably supporting at least a portion of shuttle contact therein when said plunger means is in its first position such that said shuttle contact is located out of engagement with said interior contact, incompressible fluid means located at least partially between said shuttle contact and said plunger means.

said plunger means being moveable, by force applied to its end opposite its opening, from its first position to its second position for causing said incompressible fluid means to apply pressure to said shuttle contact for causing said shuttle contact to be released from said plunger means for movement into engagement with said interior contact and with said receiving contact for forming an electrical connection between said two leads.

15. The switch of claim 14, wherein:

the structure of said plunger means forming said opening and said portion of said shuttle contact comprise means for releasably supporting said portion of said shuttle contact in said opening of said plunger means.

16. The switch of claim 14, wherein:

said plunger means comprises a central electrical conducting member with an opening formed in one end defining said opening of said plunger means for releasably supporting said portion of said shuttle contact therein, an electrical insulating sleeve surrounding an intermediate portion of said electrical conducting member whereby said one end of said electrical conducting member and an end opposite said one end extend out of opposite ends of said sleeve, said shuttle contact when located in said opening of said electrical conducting member engages said electrical conducting member such that said shuttle contact and said electrical conducting member are electrically connected together, an end of said shuttle contact engages the inside wall of said receiving contact when said plunder means is in said first position whereby an electrical connected is provided between said first lead and said opposite end of said electrical conducting member by way of said receiving contact, said shuttle contact, and said electrical conducting member when said plunger means is in said first position.

17. The switch of claim 16, wherein said incompressible fluid means comprises:

an electrical insulating highly viscous grease located in said opening of said body member at least partially between said shuttle contact and said plunger means and around a portion of said shuttle contact and within said opening of said electrical insulation receiving means between said shuttle contact and said electrically insulating member, when said plunger means is located in said first position.

18. The switch of claim 16, wherein said incompressible fluid means comprises:

an electrically insulating highly viscous grease located in said opening of said electrical conducting member between said shuttle contact and the wall of said opening of said electrical conducting member, when said shuttle contact is located in said opening of said electrical conducting member.

19. The switch of claim 16, wherein:

the structure of said electrical conducting member forming said opening of said electrical conducting member and said portion of said shuttle contact comprise means for releasably supporting said portion of said shuttle contact in said opening of said electrical conducting member.

20. The switch of claim 16, wherein said incompressible fluid means comprises:

an electrical insulating highly viscous grease located at least partially between said shuttle contact and said plunger means, when said plunger means is located in said first position.

21. The switch of claim 20, wherein: said one end of said receiving contact and at least a portion of the exterior wall thereof are spaced from said insulating receiving means forming a fluid flow space for said electrically insulating highly viscous grease.

22. The switch of claim 21, wherein:

the structure of said electrical conducting member forming said opening of said electrical conducting member and said portion of said shuttle contact comprise means for releasably supporting said portion of said shuttle contact in said opening of said electrical conducting member.

* * * * *